US006915540B2

(12) United States Patent
Trbovich, Jr. et al.

(10) Patent No.: US 6,915,540 B2
(45) Date of Patent: Jul. 12, 2005

(54) BAYONET WITH INSULATED EXTENSION ROD

(75) Inventors: Nick Trbovich, Jr., Orchard Park, NY (US); Kathlyn Susan Green, Machias, NY (US)

(73) Assignee: The Ontario Knife Company, Franklinville, NY (US)

( * ) Notice: Subject to any disclaimer, the term of this patent is extended or adjusted under 35 U.S.C. 154(b) by 92 days.

(21) Appl. No.: 10/331,391

(22) Filed: Dec. 30, 2002

(65) Prior Publication Data

US 2003/0159220 A1 Aug. 28, 2003

Related U.S. Application Data

(60) Provisional application No. 60/343,762, filed on Dec. 28, 2001.

(51) Int. Cl.[7] ..... B25F 1/00
(52) U.S. Cl. ..... 7/107; 7/108; 7/118
(58) Field of Search ..... 7/107, 108, 118, 7/119, 163, 164, 167; 81/489, 177.1

(56) References Cited

U.S. PATENT DOCUMENTS 3,370,163 A * 2/1968 Brill ..... 362/119
3,842,458 A * 10/1974 Bauer ..... 7/134
4,720,030 A * 1/1988 Petrovich ..... 224/232
4,821,356 A * 4/1989 Finn ..... 7/134
5,713,656 A * 2/1998 Lin ..... 362/120
6,378,569 B1 * 4/2002 Hays ..... 140/123.6
6,460,433 B1 * 10/2002 Ackeret et al. ..... 81/440

* cited by examiner

*Primary Examiner*—Joseph J. Hail, III
*Assistant Examiner*—Alvin J Grant
(74) *Attorney, Agent, or Firm*—Jaeckle Fleischmann & Mugel, LLP

(57) ABSTRACT

The invention provides bayonet or survival knife 100 that insulates the user from electric shock. With the insulated bayonet or knife, the user can safely cut a wire regardless of whether the wire is electrified or not. As a further improvement, the invention provides the soldier with an indicator to warn the soldier or user that the wire that is being cut is also electrified. In one of its embodiments the invention provides a voltage indicator circuit that includes, in series, blade 102 and hand guard 104 of bayonet or knife 100, resistor 106, light bulb 108 such as a neon bulb, and electrical thumb terminal 110 embedded in insulating handle 112. Metal blade 102 and metal butt or bayonet latch 114 on the end of handle 112 are electrically isolated from each other by insulating extension rod 116.

10 Claims, 11 Drawing Sheets

116

Bowie Blade Assembly

Bowie Blade Assembly End Views

Short Blade Assembly

Short Blade Assembly End Views

Wire Cutter Blade Assembly

Wire Cutter Blade Assembly

Scabbard with wire cutter fitting

BAYONET WITH INSULATED EXTENSION ROD

CROSS REFERENCE TO RELATED APPLICATIONS

This application claims priority of U.S. Provisional Patent Application Ser. No. 60/343,762, filed Dec. 28, 2001.

FIELD OF THE INVENTION

This invention relates to bayonets and survival knives.

BACKGROUND OF THE INVENTION

Military knives and bayonets are customary weapons of ground combat forces. A bayonet is usually an elongated weapon that can be fixed to the end of the barrel of a rifle. Conventional bayonets are shown and described in U.S. Pat. No. 4,821,356, issued Apr. 18, 1989, whose entire disclosure is herein incorporated by reference.

Survival knives and bayonets have been adapted to perform multiple functions. For example, many are equipped with a shearing blade that cooperates with a scabbard lug to provide wire or fabric cutters. It is also conventional to use an extension rod enclosed in a hollow handle for securing the blade to the handle. In this connection, the extension rod threads onto the tang of the bayonet or knife blade and extends toward the butt of the handle. At the handle butt, either a butt or a mounting latch for the bayonet has a receiver hole that coincides with the end of the extension rod. A suitable nut threads through the butt or the latches to secure the butt or the latches to the extension rod. In this manner, the extension rod is compressed and the blade is securely mounted to the handle.

One of the drawbacks of conventional bayonets and survival knives is that they provide no means for protecting the user from cutting into an electrified wire. It is known that defensive emplacements that include barbed wire fences and chain link fences often electrify those fences. A fence may be electrified to either shock an intruder with high voltage or detect an intruder by monitoring the resistance of the electrified fence which changes as a fence is climbed or tampered with. Thus, a wire represents two hazards to the combatant: a physical obstacle that inhibits motion and can cause cuts and bruises as well as applying an electrical shock to the soldier or alerting the security personnel of the soldier's attempt to bypass the fence. In conventional knives and bayonets, a metal extension rod connects the tang of the blade to the handle. If the wire is electrified, the metal extension rod carries the current to the far or distal end of the handle of the knife or bayonet. If that end is metal, the user of the knife or bayonet will receive an electric shock.

Alternatively, the owner of an electrified fence has a need for a bayonet or survival knife that indicates whether or not the fence is electrified. For example, a rancher who uses an electrified fence to contain animals such as cows or horses commonly uses a knife such as a survival knife while working in the field. A lack of current in the fence indicates that the fence needs repair. Therefore such a rancher needs a combination knife and voltage indicator that would allow the rancher to determine if his or her fence is electrified while he or she is in the field.

SUMMARY OF THE INVENTION

The present invention provides an insulated bayonet or knife.

The invention comprises, in one form thereof, an elongated blade having at least one cutting edge and terminating at one end in a tang and a hollow insulating handle for receiving the tang. An extension rod of electrically insulating material is enclosed in the handle and coupled at one end to the tang of the blade and at the other end to end of the handle distal from the blade for electrically insulating the blade from the distal end of the handle. The extension rod comprises an elongated body extending from the end of the handle proximate the blade to the end of the handle distal from the blade. The extension rod has a first blind bore at the proximate end for receiving the tang, a tapering portion tapering from the blind end of the first blind bore toward the distal end of the extension rod, and terminating is a second blind bore for receiving a fastener to fix the extension rod to the distal end of the handle. A hand guard is coupled to the handle at the end proximate the knife or bayonet and extends radially from the handle on opposite sides of the handle to prevent a user's hand from slipping onto the blade.

An electrical terminal and a voltage indicating electrical circuit are located on or embedded in the handle. The electrical circuit comprises a light source or other voltage indicating means with one end electrically connected in series with the blade and the other end connected to the electrical terminal on the handle. Further, a resistor is connected in series with the light source. The light source is embedded in the handle on either the left side or the right side of the handle and the electrical terminal on the handle is disposed in the handle on the dorsal surface.

An advantage of the present invention is that the extension rod and the handle are insulating and therefore protect the user from an electric shock when the blade contacts an electrified surface such as an electric fence.

A further advantage of the present invention is that the handle of the knife or bayonet includes means to indicate that the blade is in contact with an electrified surface such as an electric fence.

BRIEF DESCRIPTION OF THE DRAWINGS

The above-mentioned and other features and advantages of this invention, and the manner of attaining them, will become apparent and be better understood by reference to the following description of the embodiments of the invention in conjunction with the accompanying drawings, wherein.

Corresponding reference characters indicate corresponding parts throughout the several views. The exemplifications set out herein illustrate the preferred embodiments of the invention and such exemplifications are not to be construed as limiting the scope of the invention in any manner.

DETAILED DESCRIPTION

Figure 1:
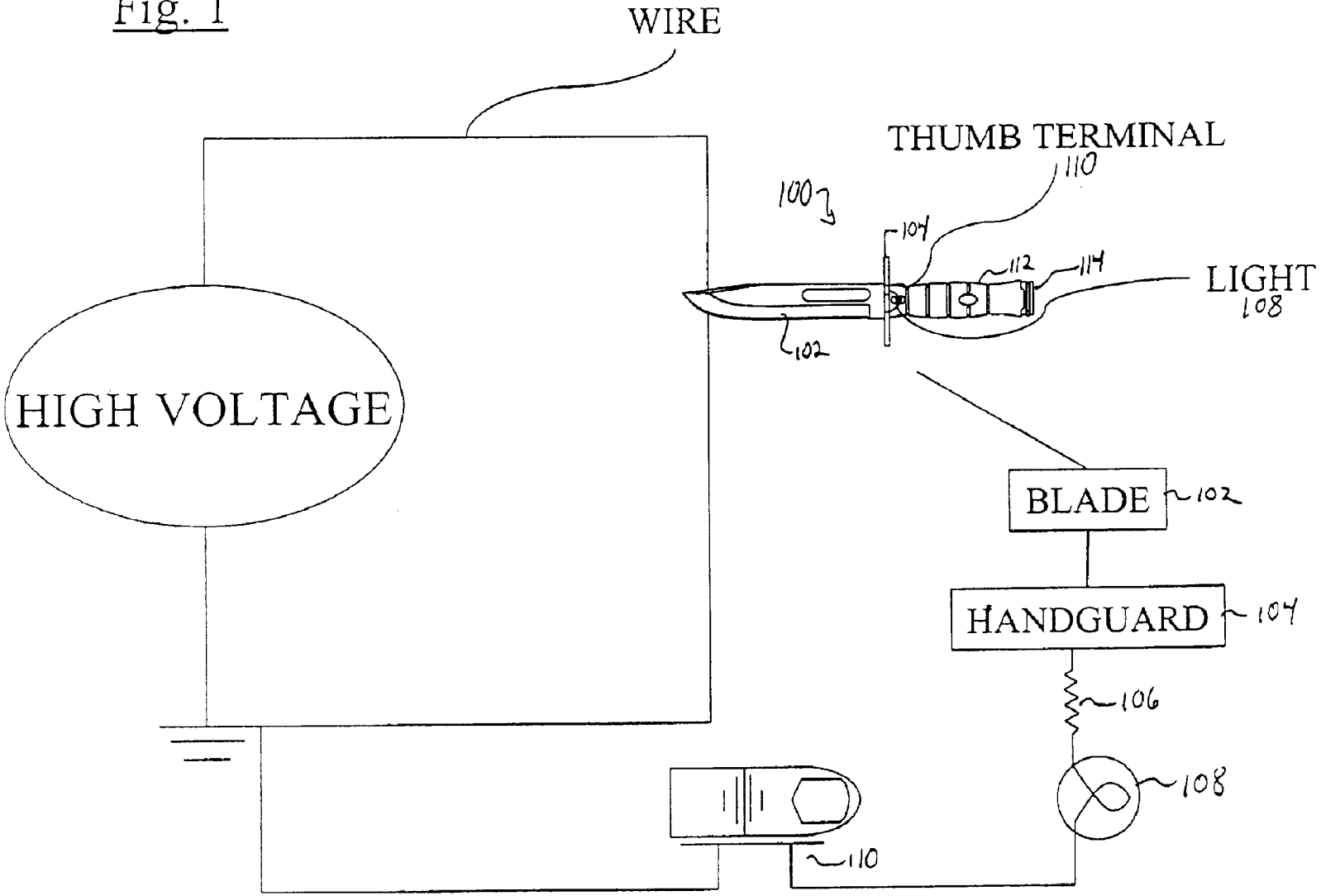
FIG. 1 is a voltage indicator circuit schematic of the bayonet with indicator of the present invention.
Figures 2A, 2B, 2C, 2D:
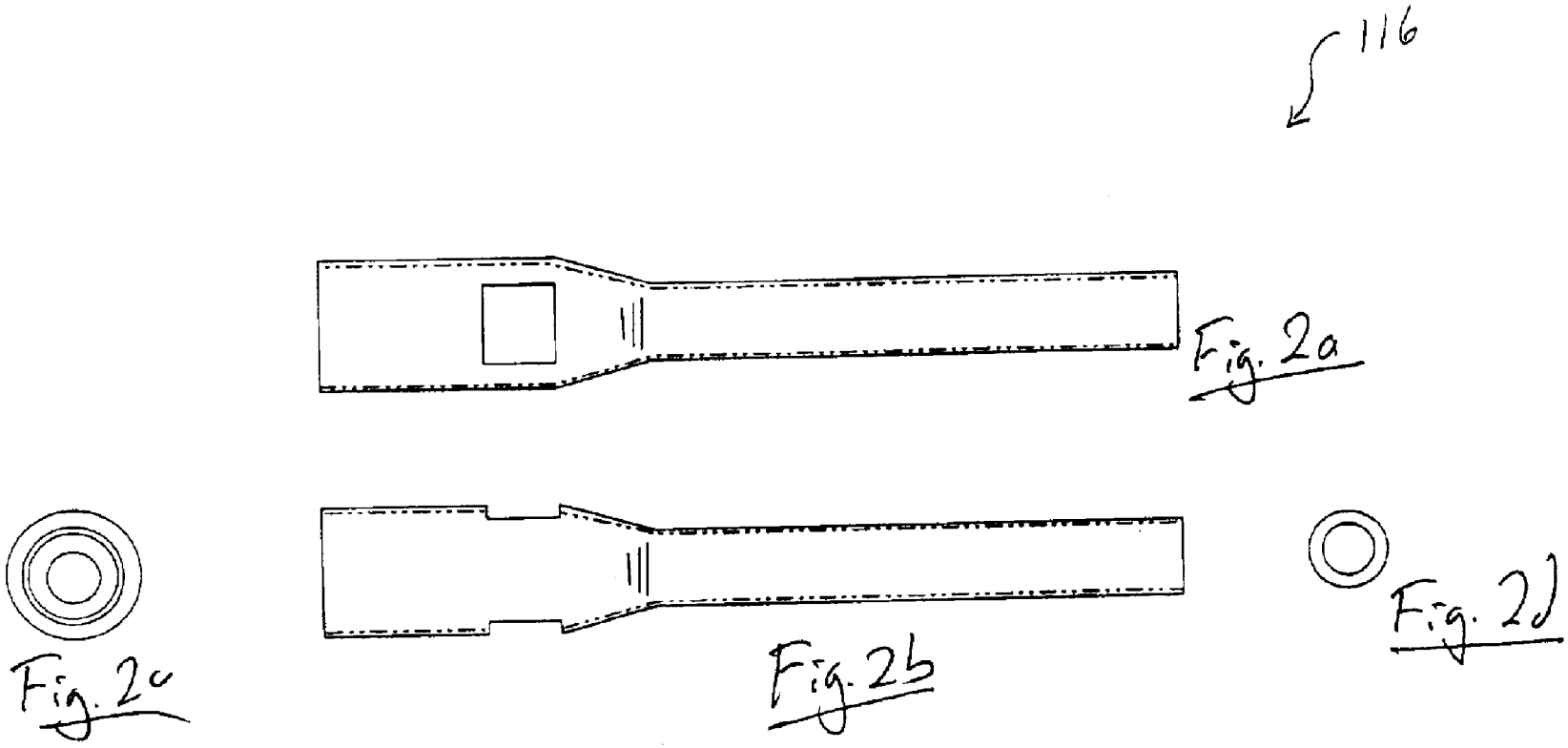
FIG. 2*a* is a top view of the insulated extension rod of the present invention.
FIG. 2*b* is a side view of the insulated extension rod of the present invention.
FIG. 2*c* is a first end view of the insulated extension rod of the present invention.
FIG. 2*d* is a second end view of the insulated extension rod of the present invention.
Figure 3A:
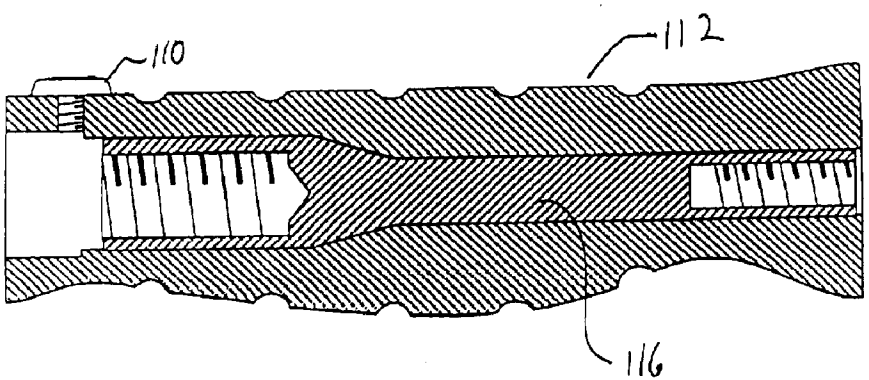
FIG. 3*a* is a cross-sectional view of the insulated handle of FIG. 1 and insulated extension rod of FIG. 2.

Referring now to FIG. 1, the invention provides bayonet or survival knife 100 that insulates the user from electric shock. With the insulated bayonet or knife, the user can safely cut a wire regardless of whether the wire is electrified or not. As a further improvement, the invention provides the soldier with an indicator to warn the soldier or user that the wire that is being cut is also electrified. In one of its embodiments the invention provides a voltage indicator circuit that includes, in series, blade 102 and hand guard 104 of bayonet or knife 100, resistor 106, light bulb 108 such as a neon bulb, and electrical thumb terminal 110 embedded in insulating handle 112. Metal blade 102 and metal butt or bayonet latch 114 on the end of handle 112 are electrically isolated from each other by insulating extension rod 116 shown in FIGS. 2*a* through *d*. Insulating extension rod 116 has a blind bore at one end with a threaded metal insert for receiving the threaded end of the tang on blade 102. The other end of extension rod 116 is also threaded. It may or may not include a metal-threaded insert. A suitable bolt passes through an opening in butt closure or latches 114 to engage the threads and extension rod 116 and thereby hold blade 102 firmly in place in handle 112 as shown in FIG. 3*a*. Handle 112 itself is made of insulating material such as nylon.

Figure 3B:
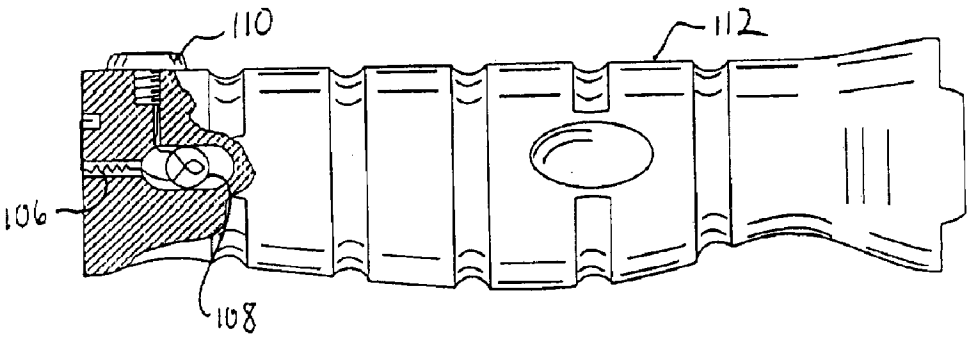
FIG. 3*b* is a cut-away view of the insulated handle of FIG. 1 showing the voltage indicator circuit of FIG. 1.
Figure 3C:
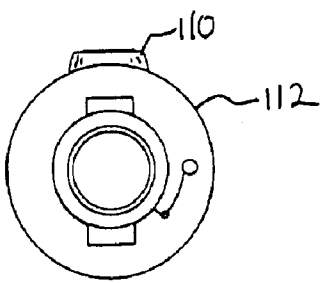
FIG. 3*c* is an end view of the insulated handle of FIG. 1.

On the dorsal surface of handle 112 there is conductive metal terminal 110. As best shown in FIG. 3*b*, conductive metal terminal 110 is coupled at one end of the conductor that leads to neon bulb 108. Alternatively, neon bulb 108 may be replaced by another voltage indicating means such as a light emitting diode, an oscillating motor to cause the handle 112 to vibrate, a device to produce an audible noise, a color changing strip, or a meter. The other conductor leading from neon bulb 108 includes resistor 106 and lies across the end face of handle 112 as shown in FIG. 3*c* and electrically and mechanically contacts hand guard 104 that is located between handle 112 and blade 102. Bulb 108 may be molded into handle 112 on either the left or the right side. In this way, the soldier who is left-handed or right-handled can be equipped with the suitable handled bayonet or knife.

In operation the user touches the tip of blade 102 to the wire under investigation as best seen in FIG. 1. The user keeps the fingers of his or her hand on the insulating portion of handle 112 and does not touch hand guard 104. Since latches or butt end 114 of handle 112 are insulated from hand guard 104 via insulating extension rod 116, the user is permitted to allow his or her hand to contact the far end of handle 112. If the wire is electrified, then an electric current can be established from the wire to blade 102 to hand guard 104 through resistor 106 and bulb 108 and to thumb terminal 110 on handle 112. When the user places his or her thumb on terminal 110, the circuit is grounded and, if the wire is electrified, neon lamp 108 will glow. It is understood that the user, by placing his or her thumb on terminal 110, is connected only at one end of the circuit and not to the other. The user remains fully insulated from the electrified wire by insulating handle 112 and insulating extension rod 116.

The invention thus provides an improved combination voltage indicator and bayonet or survival knife. Improved bayonet or knife 100 is somewhat lighter than its corresponding conventional counterpart because extension rod 116 is made of a lighter material such as plastic, that is also electrically insulating.

Figures 4A, 4B, 4C:
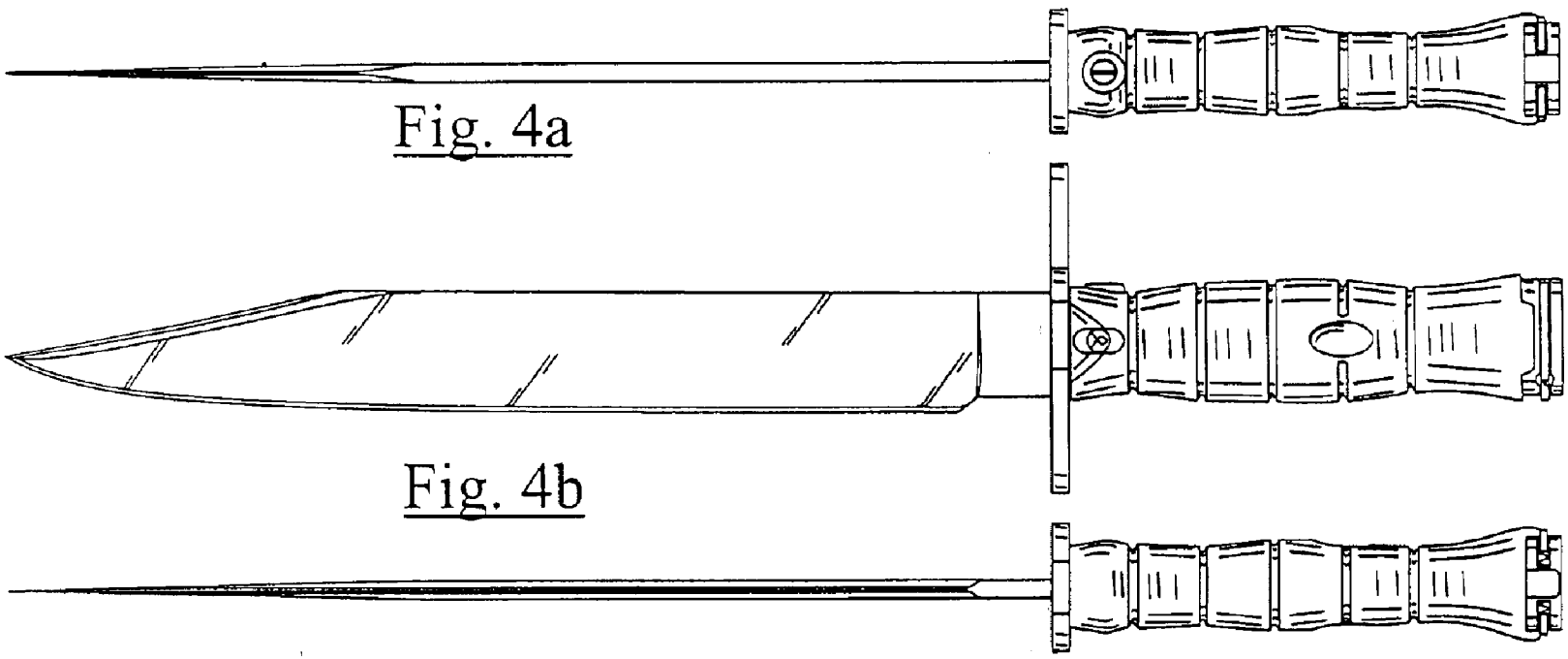
FIG. 4*a* is a top view of the bowie blade embodiment of the present invention.
FIG. 4*b* is a side view of the bowie blade embodiment of the present invention.
FIG. 4*c* is a bottom view of the bowie blade embodiment of the present invention.
Figure 4E:
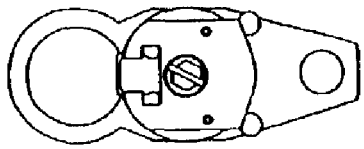
FIG. 4*e* is a second end view of the bowie blade embodiment of the present invention.
Figure 4D:
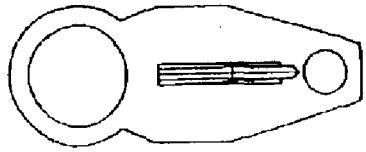
FIG. 4*d* is a first end view of the bowie blade embodiment of the present invention.
Figure 5A:
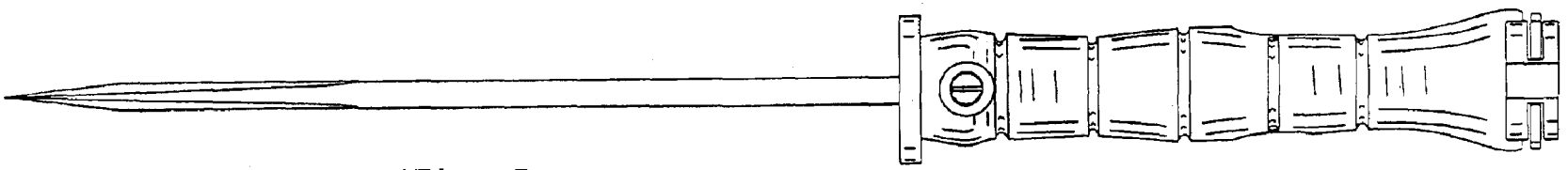
FIG. 5*a* is a top view of the short blade embodiment of the present invention.
Figure 5B:
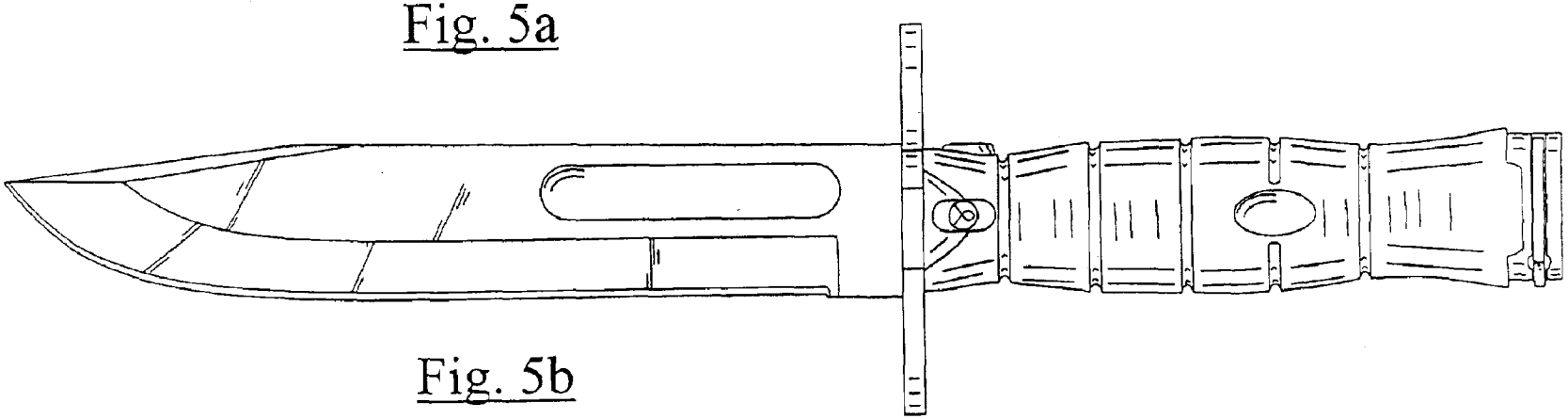
FIG. 5*b* is a side view of the short blade embodiment of the present invention.
Figure 5C:
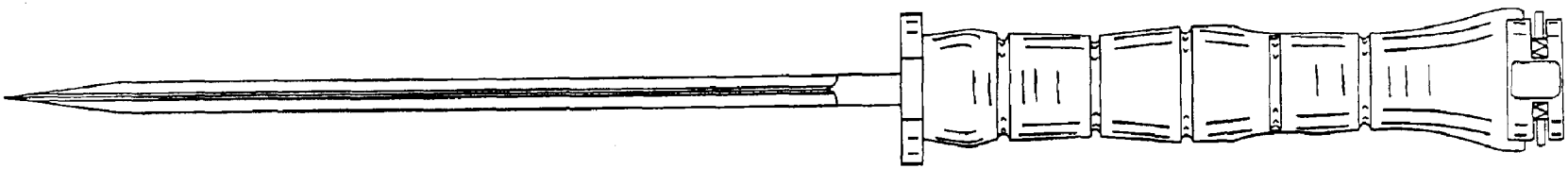
FIG. 5*c* is a bottom view of the short blade embodiment of the present invention.
Figure 5E:
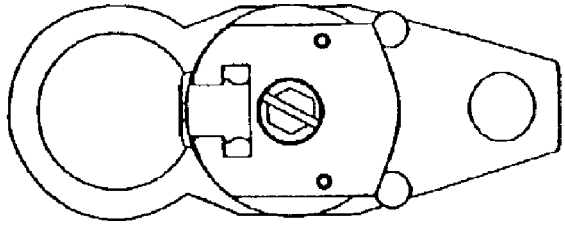
FIG. 5*e* is a second end view of the short blade embodiment of the present invention.
Figure 5D:
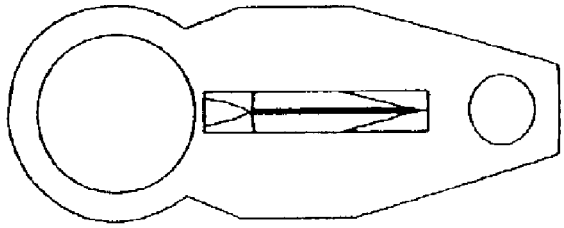
FIG. 5*d* is a first end view of the short blade embodiment of the present invention.
Figures 6A, 6B, 6C:
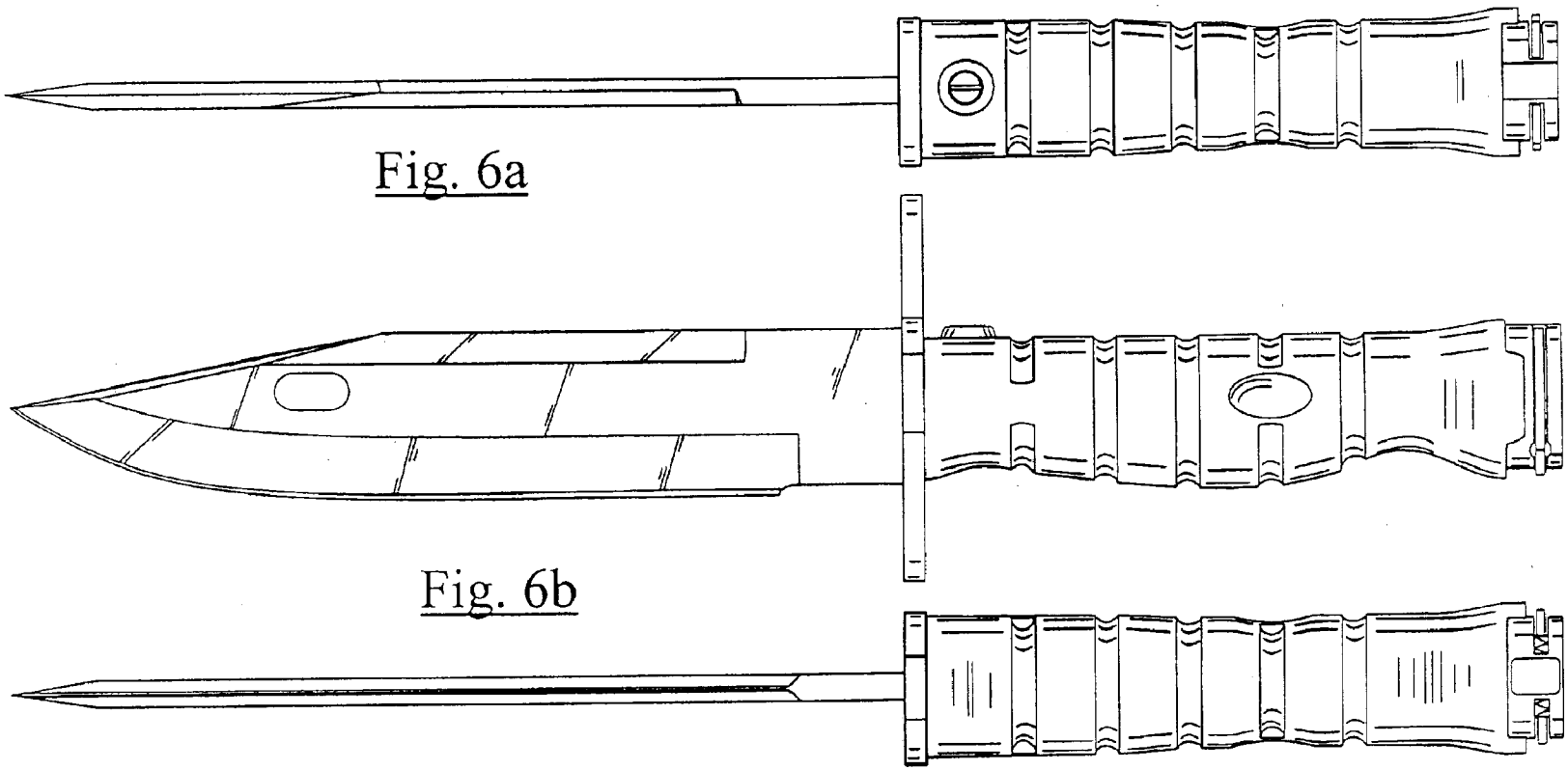
FIG. 6*a* is a top view of the wire cutter blade embodiment of the present invention.
FIG. 6*b* is a first side view of the wire cutter blade embodiment of the present invention.
FIG. 6*c* is a bottom view of the wire cutter blade embodiment of the present invention.
Figure 6D:
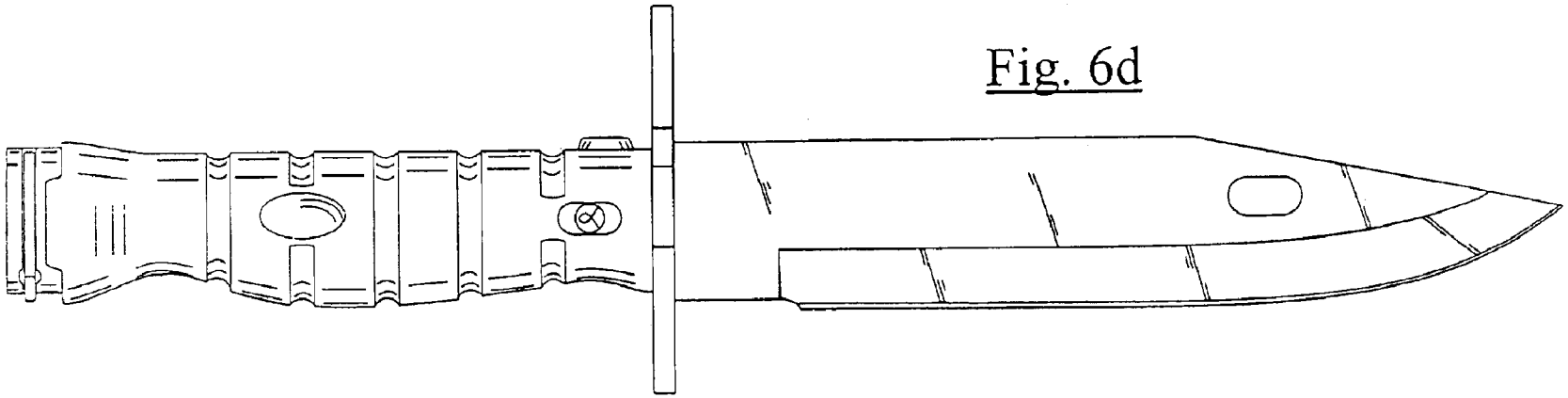
FIG. 6*d* is a second side view of the wire cutter blade embodiment of the present invention.
Figure 6F:
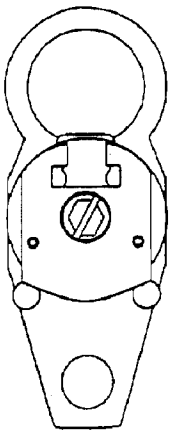
FIG. 6*f* is a second end view of the wire cutter blade embodiment of the present invention.
Figure 6E:
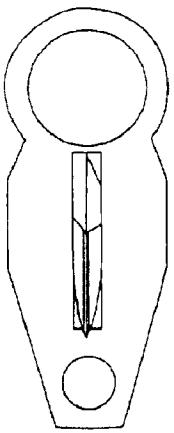
FIG. 6*e* is a first end view of the wire cutter blade embodiment of the present invention.
Figure 7A:
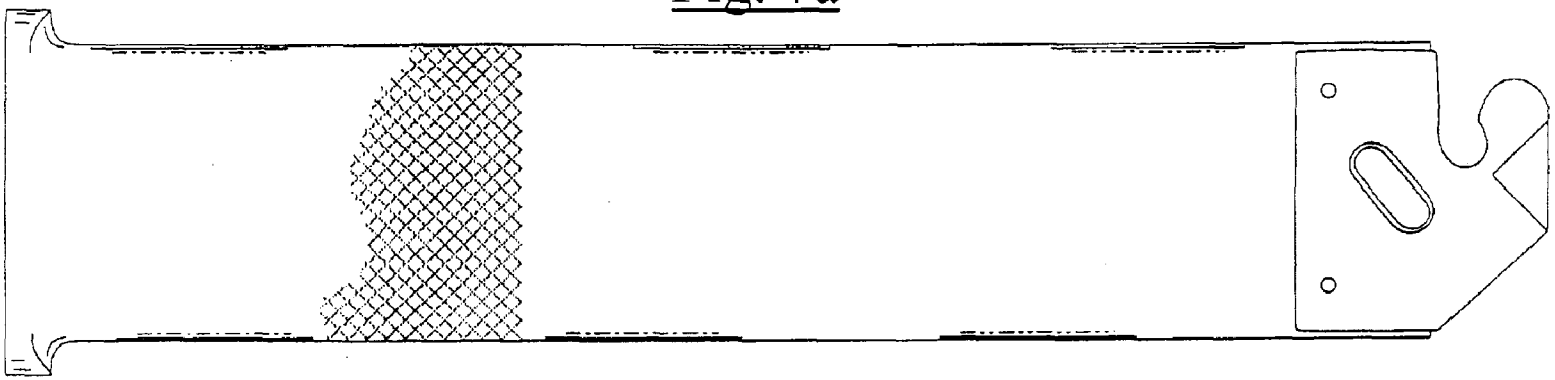
FIG. 7*a* is a plan view of a scabbard with wire cutter fitting of the present invention.
Figure 7B:
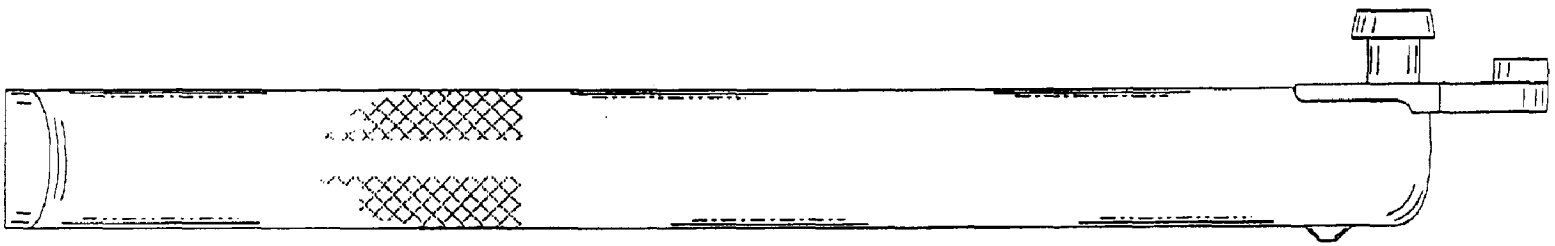
FIG. 7*b* is a side view of a scabbard with wire cutter fitting of the present invention.
Figure 8:
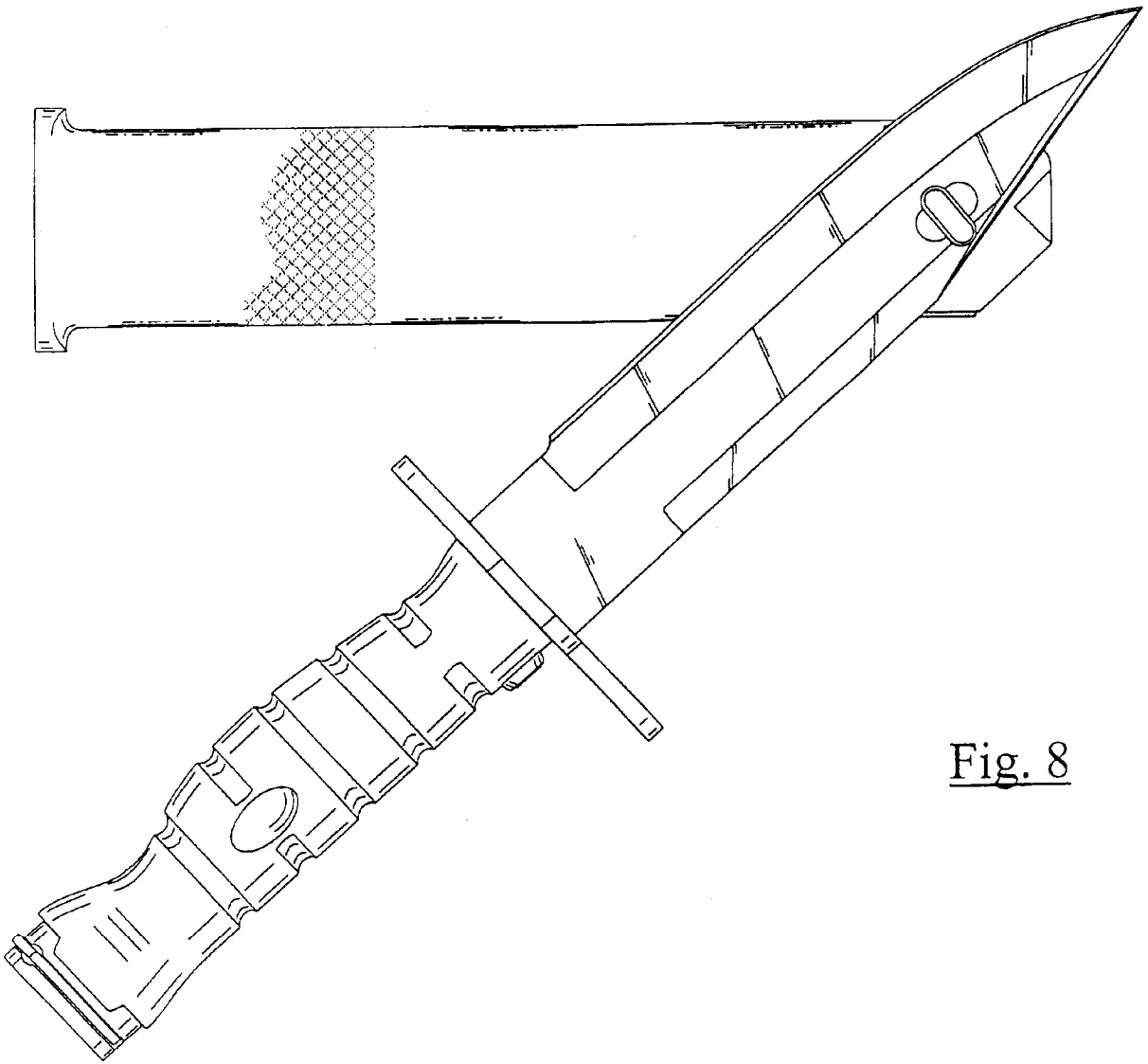
FIG. 8 is a plan view of the wire cutter blade of FIG. 6*b* engaging the wire cutter fitting of 7*a*.

The invention may be used in connection with conventional long bayonets or with novel shorter bayonets. Examples of both types of bayonets are included in this disclosure. The elongated bayonet showed in several views in FIGS. 4*a* through 4*e* is fairly unique by having a Bowie-type tip. This Bowie-type tip has a slightly reversed curve and sharp edge on the upper surface thereof as best seen in FIG. 4*b*. This is contrary to conventional bayonets that have symmetrical blades on both sides. The Bowie-type blade is shown in combination with a double belly style handle. The invention may also be used in connection with shorter type bayonets such as those shown in the attached figures. FIGS. 5*a* through 5*e* show several views of a bayonet or survival knife with a short blade in combination with a double belly handle. Another bayonet shown in FIGS. 6*a* through 6*f* includes a wire cutter in conjunction with a scabbard with a scabbard lug shown in FIGS. 7*a* and 7*b*. The scabbard lug fits into a hole in the wire cutter blade and the shape of the top of the wire cutter blade and the end of the scabbard cooperate to form a wire cutter as shown in FIG. 8. The wire cutter blade is shown in combination with a single belly style handle and has a left-handed configuration of light 108. Even when the bayonet is not equipped with a wire cutter, the voltage indicator can still provide the soldier with information that a wire is electrified.

Other novel features of the invention include two differently shaped handles. In one, the handle has a double belly as shown in FIGS. 4*a* through 4*e* and 5*a* through 5*e*. In the other embodiment, the handle has a straight back and a single belly as shown in FIGS. 6*a* through 6*f*. Referring to the double belly and the straight back, applicants are describing the shape of the ventral and dorsal sides of the handle. The lateral sides are also suitable curved. In one embodiment, the handle has an hourglass lateral curve. The other handle has a double curve on opposite sides. Both handle styles are shown in the drawings having an oval on each side about midway between the ends of the handle. This is for a label that may designate the manufacturer of the bayonet or knife, the owner of the bayonet or knife, and/or the type of bayonet or knife it is.

In summary, the invention provides an insulated knife or bayonet that allows a user to safely cut a wire that may be electrified. This feature is provided by the extension rod that is made of insulating material and by the insulated handle. The voltage indicator is an added feature for determining whether the wire to be cut is electrified or not.

It should be particularly noted that thumb terminal 110 serves several purposes. As described above, thumb terminal 110 allows the user to ground the circuit. The projecting nature of thumb terminal 110 also allows the user to properly orient knife 100 in the dark. The user easily feels thumb terminal 110 and immediately knows that blade 102 is directed in the opposite direction. Also, it is well known that when a bayonet is attached to a weapon, hand guard 104 of bayonet 100 may get quite hot. In that situation and in the situation described above where blade 102 is in contact with an electrified fence, the projecting nature of thumb terminal 110 allows the user to ensure that his or her hands do not come in contact with the hot or electrified hand guard 104 by keeping them behind thumb terminal 110.

It should be further particularly noted that while the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

What is claimed is:

1. An insulated bayonet or knife comprising:

an elongated blade having at least one cutting edge and terminating at one end in a tang;

a hollow insulating handle for receiving the tang, an extension rod of electrically insulating material, enclosed in the handle and coupled at one end to the tang of the blade and the other end to the handle distal from the blade for electrically insulating the blade from the distal end of the handle.

2. The insulated bayonet or knife of claim 1 wherein the knife or bayonet further comprises latch plates located at the end of the insulating handle distal from the blade and operable to open and close on receiver lugs of a firearm.

3. The insulated bayonet or knife of claim 1 further comprising a hand guard coupled to the handle at the end proximate the knife or bayonet and extending radially from the handle on opposite sides of the handle to prevent a user's hand from slipping onto the blade.

4. The insulated bayonet or knife of claim 1 wherein the handle further comprises an electrical terminal and a electrical circuit with a voltage indicating means and with one end electrically connected in series with the blade and the other end connected to the electrical terminal on the handle.

5. The insulated bayonet or knife of claim 4 wherein the electrical circuit further comprises a resistor in series with the voltage indicating means.

6. The insulated bayonet or knife of claim 4 wherein the voltage indicating means comprises a neon bulb.

7. The insulated bayonet or knife of claim 6 wherein the extension rod comprises an elongated body extending from the end of the handle proximate the blade to the end of the handle distal from the blade, having a first blind bore at the proximate end for receiving the tang, a tapering portion tapering from the blind end of the first blind bore toward the distal end of the extension rod, and terminating is a second blind bore for receiving a fastener to fix the extension rod to the distal end of the handle.

8. The insulated bayonet or knife of claim 4 wherein the handle has dorsal and ventral surfaces and side surfaces, the voltage indicating means is embedded in the handle on one of the side surfaces and the electrical terminal on the handle is disposed in the handle on the dorsal surface.

9. The insulated bayonet or knife of claim 8 wherein the voltage indicating means is located on the left side.

10. The insulated bayonet or knife of claim 9 wherein the voltage indicating means is located on the right side.

* * * * *